US011814267B2

(12) United States Patent
Babu

(10) Patent No.: US 11,814,267 B2
(45) Date of Patent: Nov. 14, 2023

(54) SEAL ASSEMBLY FOR A PNEUMATIC VACUUM ELEVATOR

(71) Applicant: Killakathu Ramanathan Babu, Tamilnadu (IN)

(72) Inventor: Killakathu Ramanathan Babu, Tamilnadu (IN)

(73) Assignee: Killakathu Ramanathan Babu

( * ) Notice: Subject to any disclaimer, the term of this patent is extended or adjusted under 35 U.S.C. 154(b) by 0 days.

(21) Appl. No.: 17/928,628

(22) PCT Filed: May 31, 2021

(86) PCT No.: PCT/IB2021/054764

§ 371 (c)(1),
(2) Date: Nov. 30, 2022

(87) PCT Pub. No.: WO2021/245536

PCT Pub. Date: Dec. 9, 2021

(65) Prior Publication Data

US 2023/0192444 A1 Jun. 22, 2023

(30) Foreign Application Priority Data

Jun. 2, 2020 (IN) ..... 202041023079

(51) Int. Cl.
*B66B 9/04* (2006.01)
*B66B 11/02* (2006.01)

(52) U.S. Cl.
CPC ..... *B66B 9/04* (2013.01); *B66B 11/0226* (2013.01); *B66B 11/0266* (2013.01)

(58) Field of Classification Search
CPC .... B66B 9/04; B66B 11/0226; B66B 11/0266
See application file for complete search history.

(56) References Cited

U.S. PATENT DOCUMENTS 2,927,661 A * 3/1960 Kristek ..... B66B 9/04 187/360
3,949,953 A * 4/1976 Hopkins ..... B65G 51/06 406/185
5,005,672 A * 4/1991 Nakai ..... H02K 41/025 187/250

(Continued)

FOREIGN PATENT DOCUMENTS

CN 104787645 A * 7/2015 ..... B66B 7/00
CN 104787645 B 6/2018

(Continued)

*Primary Examiner* — Michael A Riegelman
(74) *Attorney, Agent, or Firm* — Jason C. Cameron

(57) ABSTRACT

A seal assembly for a pneumatic vacuum elevator is disclosed. The seal assembly comprises an elevator cabin structural sealing plate. The elevator cabin structural sealing plate is adapted to fit over a top portion of a cylindrical elevator cabin. The elevator cabin structural sealing plate is characterised by a top plate, a seal cover outer plate, a plurality of U-shaped corner plates, a set of reinforcement bars, at least one bumper and liner plates. Mechanical coupling of the plurality of U-shaped corner plates, the set of reinforcement bars, at least one bumper and liner plates allow easy movement of an elevator cabin through the elevator cylinder without vibrations.

5 Claims, 6 Drawing Sheets

(56) References Cited

U.S. PATENT DOCUMENTS

| | | | | | |
|---|---|---|---|---|---|
| 5,181,807 | A * | 1/1993 | Anders | B65G 51/06 | 406/190 |
| 5,447,211 | A * | 9/1995 | Sors | B66B 9/04 | 187/277 |
| 5,512,791 | A * | 4/1996 | Cho | H02K 41/02 | 187/250 |
| 5,583,326 | A * | 12/1996 | Sors | B66B 9/04 | 187/277 |
| 9,617,121 | B2 * | 4/2017 | Bolme | B66B 19/002 | |
| 10,233,055 | B1 * | 3/2019 | Ascua | B66B 11/026 | |
| 2002/0029938 | A1 * | 3/2002 | Sors | B66B 17/12 | 187/345 |
| 2023/0126885 | A1 * | 4/2023 | Babu | B66B 7/024 | 187/408 |

FOREIGN PATENT DOCUMENTS

| | | | | |
|---|---|---|---|---|
| EP | 3498651 | A2 | | 6/2019 |
| WO | WO-2021245455 | A1 | * | 12/2021 |
| WO | WO-2022175730 | A1 | * | 8/2022 |
| WO | WO-2023021322 | A1 | * | 2/2023 |

* cited by examiner

SEAL ASSEMBLY FOR A PNEUMATIC VACUUM ELEVATOR

CROSS-REFERENCE TO RELATED APPLICATION

This Application claims priority from a Patent application filed in India having Patent Application No. 202041023079, filed on Jun. 2, 2020, and titled "SEAL ASSEMBLY FOR A PNEUMATIC VACUUM ELEVATOR" and a PCT Application No. PCT/IB2021/054764 filed on May 31, 2021, and titled "SEAL ASSEMBLY FOR A PNEUMATIC VACUUM ELEVATOR".

FIELD OF INVENTION

Embodiments of a present disclosure relates to a pneumatic vacuum elevator, and more particularly to a seal assembly for the pneumatic vacuum elevator.

BACKGROUND

In conventional approach, mechanical elevators use countervailing weights in order to facilitate moving up and down of a passenger cabin. Such, typical elevators require a great deal of space, maintenance, equipment and machinery. The pneumatic vacuum elevator uses air pressure to cause motion of the passenger cabin within a thoroughfare or tubular cylinder. The mechanism uses the air within the tubular cylinder as a working fluid. Brakes, motors, valves, electronic controls and other equipment work in tandem to ensure a safe and pleasant riding experience for each occupant therein.

A seal assembly is an important equipment attached on top of a pneumatic vacuum elevator. The seal assembly enables a frictionless movement and an easy elevation of the cabin due to the pneumatic depression generated on the upper part of the tubular cylinder. In operation, the elevator cabin undergoes a rough transition as the cabin moves from one location to another. The elevator cabin experiences vibrations during, the vertical movement in the elevator cylinder.

The presently known sealing units or assemblies are very efficient in reducing vibrations during the movement of the cabin while sealing the cabin in elevator cylinder.

Hence, there is a need for an improved seal assembly for a pneumatic vacuum elevator to address the aforementioned issues.

BRIEF DESCRIPTION

In accordance with one embodiment of the disclosure, a seal assembly for a pneumatic vacuum elevator is disclosed. The seal assembly comprises an elevator cabin structural sealing plate. The elevator cabin structural sealing plate is adapted to fit over a top portion of a cylindrical elevator cabin. The elevator cabin structural sealing plate is characterised by a top plate. The top plate is configured to house adjoining elevator cabin structural sealing plate components with mechanical and adhesive coupling.

The elevator cabin structural sealing plate is also characterised by a seal cover outer plate. The seal cover outer plate is mechanically coupled along edges of the top plate. The seal cover outer plate is configured to provide a covering to the elevator cabin structural sealing plate from sideways. The elevator cabin structural sealing plate is also characterised by a plurality of u-shaped corner plates. The plurality of u-shaped corner plates is fabricated at outer circumference of the seal cover outer plate at predefined positions. The plurality of u-shaped corner plates is adapted to receive at least one guide rail thereby enabling upward and downward movement of the cylindrical elevator cabin via the guiding rails in predefined path.

The elevator cabin structural sealing plate is also characterised by a set of reinforcement bars. The set of reinforcement bars is mechanically coupled to bottom surface of the top plate in lateral plane and inner circumference of the seal cover outer plate. The set of reinforcement bars together form a predefined shape comprising a plurality of u-shaped inward depressions corresponding to the plurality of u-shaped corner plates thereby supporting the plurality of u-shaped corner plates, the steel cover outer plate and the steel top plate. The elevator cabin structural sealing plate is also characterised by at least one bumper and liner plates. The at least one bumper and liner plates are affixed over outer circumference of the seal cover outer plate and press against inner wall of elevator cylinder. The bumper and liner plates comprise outward protrusion which remain constantly in touch with inner wall of elevator cylinder thereby sealing the cylindrical elevator cabin and reducing vibrations during upward and downward movement.

In accordance with another embodiment of the disclosure, a pneumatic vacuum elevator is disclosed. The pneumatic vacuum elevator includes an elevator cylinder adapted to house pneumatic vacuum elevator components. The pneumatic vacuum elevator components include a head cylinder assembly mechanically affixed just below the ceiling of the top floor for housing a seal assembly and at least one motor. The pneumatic vacuum elevator components also include a cylindrical elevator cabin positioned below a head cylinder assembly and adapted for upward and downward movement through one or more floor levels. The pneumatic vacuum elevator components also include an intermediate cylinder assembly mechanically affixed in between each of the one or more floors and adapted to provide requisite space for easy movement of the cylindrical elevator cabin between each of the one or more floors.

To further clarify the advantages and features of the present disclosure, a more particular description of the disclosure will follow by reference to specific embodiments thereof, which are illustrated in the appended figures. It is to be appreciated that these figures depict only typical embodiments of the disclosure and are therefore not to be considered limiting in scope. The disclosure will be described and explained with additional specificity and detail with the appended figures.

BRIEF DESCRIPTION OF THE DRAWINGS

The disclosure will be described and explained with additional specificity and detail with the accompanying figures in which:

FIG. 3(*b*) is a front view representation of an elevator cabin structural sealing plate corresponding to the seal assembly in accordance with an embodiment of the present disclosure;

FIG. 4(*b*) is an assembled isometric bottom view representation of the elevator cabin structural sealing plate corresponding to the seal assembly in accordance with an embodiment of the present disclosure;

FIG. 6(*b*) illustrate the rectangle-shaped bumper and linear plates corresponding to the seal assembly in accordance with an embodiment of the present disclosure.

Figure 1:
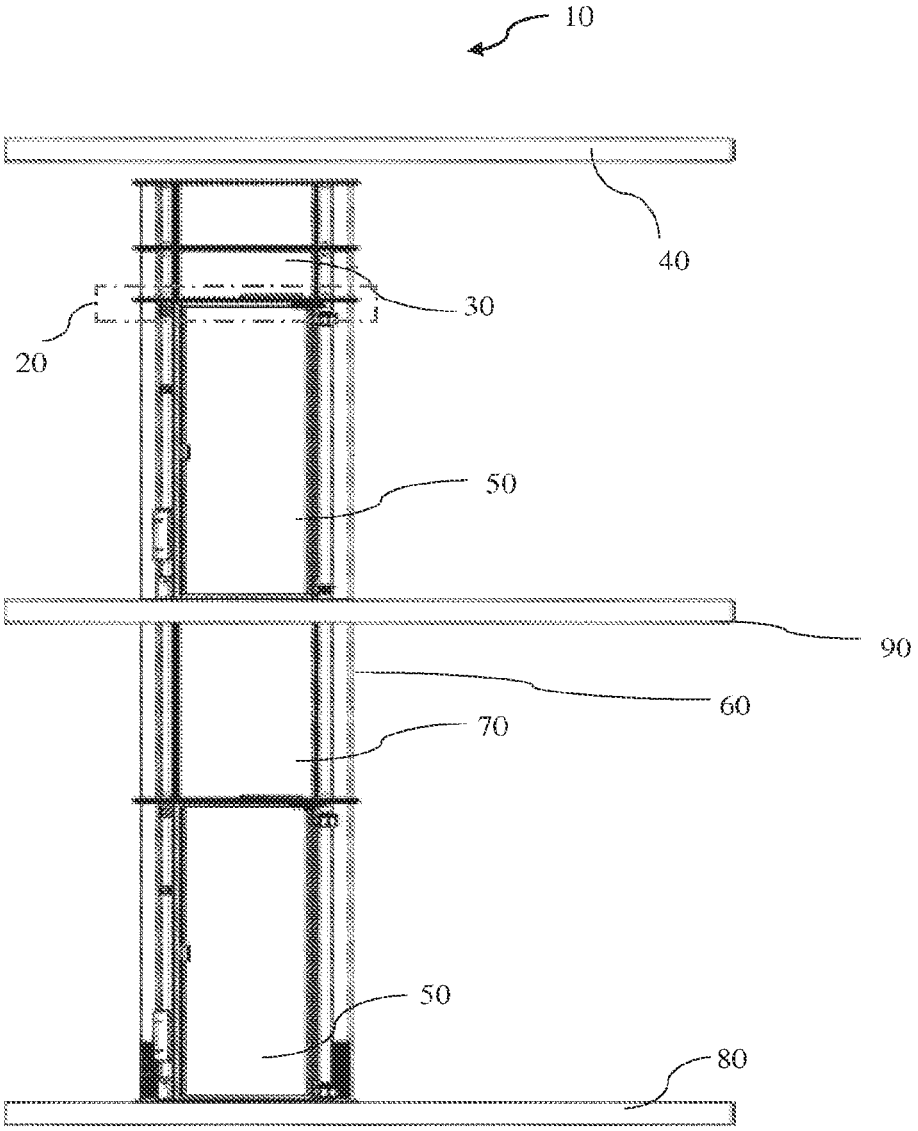
FIG. 1 is a schematic representation of a pneumatic vacuum elevator in accordance with an embodiment of the present disclosure.

Further, those skilled in the art will appreciate that elements in the figures are illustrated for simplicity and may not have necessarily been drawn to scale. Furthermore, in terms of the construction of the device, one or more components of the device may have been represented in the figures by conventional symbols, and the figures may show only those specific details that are pertinent to understanding the embodiments of the present disclosure so as not to obscure the figures with details that will be readily apparent to those skilled in the art having the benefit of the description herein.

DETAILED DESCRIPTION

For the purpose of promoting an understanding of the principles of the disclosure, reference will now be made to the embodiment illustrated in the figures and specific language will be used to describe them. It will nevertheless be understood that no limitation of the scope of the disclosure is thereby intended. Such alterations and further modifications in the illustrated online platform, and such further applications of the principles of the disclosure as would normally occur to those skilled in the art are to be construed as being within the scope of the present disclosure.

The terms "comprises", "comprising", or any other variations thereof, are intended to cover anon-exclusive inclusion, such that a process or method that comprises a list of steps does not include only those steps but may include other steps not expressly listed or inherent to such a process or method. Similarly, one or more devices or subsystems or elements or structures or components preceded by "comprises . . . a" does not, without more constraints, preclude the existence of other devices, subsystems, elements, structures, components, additional devices, additional subsystems, additional elements, additional structures or additional components. Appearances of the phrase "in an embodiment", "in another embodiment" and similar language throughout this specification may, but not necessarily do, all refer to the same embodiment.

Unless otherwise defined, all technical and scientific terms used herein have the same meaning as commonly understood by those skilled in the art to which this disclosure belongs. The system, methods, and examples provided herein are only illustrative and not intended to be limiting.

In the following specification and the claims, reference will be made to a number of terms, which shall be defined to have the following meanings. The singular forms "a", "an", and "the" include plural references unless the context clearly dictates otherwise.

Embodiments of the present disclosure relate to a seal assembly for a pneumatic vacuum elevator. The seal assembly comprises an elevator cabin structural sealing plate. The elevator cabin structural sealing plate is adapted to fit over a top portion of a cylindrical elevator cabin. The elevator cabin structural sealing plate is characterised by a top plate. The top plate is configured to house adjoining elevator cabin structural sealing plate components with mechanical and adhesive coupling.

The elevator cabin structural sealing plate is also characterised by a seal cover outer plate. The seal cover outer plate is mechanically coupled along edges of the top plate. The seal cover outer plate is configured to provide a covering to the elevator cabin structural sealing plate from sideways. The elevator cabin structural sealing plate is also characterised by a plurality of u-shaped corner plates. The plurality of u-shaped corner plates is fabricated at outer circumference of the steel cover outer plate at predefined positions. The plurality of u-shaped corner plates is adapted to receive at least one guide rail thereby enabling upward and downward movement of the cylindrical elevator cabin via the guiding rails in predefined path.

The elevator cabin structural sealing plate is also characterised by a set of reinforcement bars. The set of reinforcement bars is mechanically coupled to bottom surface of the top plate in lateral plane and inner circumference of the seal cover outer plate. The set of reinforcement bars together form a predefined shape comprising a plurality of u-shaped inward depressions corresponding to the plurality of u-shaped corner plates thereby supporting the plurality of u-shaped corner plates, the steel cover outer plate and the steel top plate. The elevator cabin structural sealing plate is also characterised by at least one bumper and liner plates. The at least one bumper and liner plates are affixed over outer circumference of the seal cover outer plate and press against inner wall of elevator cylinder. The bumper and liner plates comprise outward protrusion which remain constantly in touch with inner wall of elevator cylinder thereby sealing the cylindrical elevator cabin and reducing vibrations during upward and downward movement.

FIG. 1 is a schematic representation of a pneumatic vacuum elevator 10 in accordance with an embodiment of the present disclosure. As used herein, the machine "pneumatic elevators" utilize air pressure to lift the elevator cabin 50. In such embodiment, a vacuum seal built into the ceiling enables lifting of the elevator cabin through the elevator cabin housing.

The pneumatic vacuum elevator 10 comprises an elevator cylinder 60. The elevator cylinder 60 is adapted to house the pneumatic vacuum elevator 10 components. The pneumatic vacuum elevator 10 components include a cylindrical elevator cabin 50. The cylindrical elevator cabin 50 is adapted to provide an elevator housing for upward and downward movement through one or more floors 80 and 90.

The pneumatic vacuum elevator 10 components also include a head cylinder assembly 30. The head cylinder assembly 30 is mechanically affixed just below ceiling 40 of the top floor 90. The head cylinder assembly 30 is adapted for housing a seal assembly 20 (details of the seal assembly is provided in FIGS. 2-6) and at least one motor. The motor delivers necessary power for total functioning of the elevator during operation. The pneumatic vacuum elevator 10 components also include an intermediate cylinder assembly 70. The intermediate cylinder assembly 70 is mechanically affixed in between each of the one or more floors 80 and 90. The intermediate cylinder assembly 70 is adapted to provide requisite space for easy movement of the cylindrical elevator cabin 50 between each of the one or more floors 80 and 90.

Figure 2:
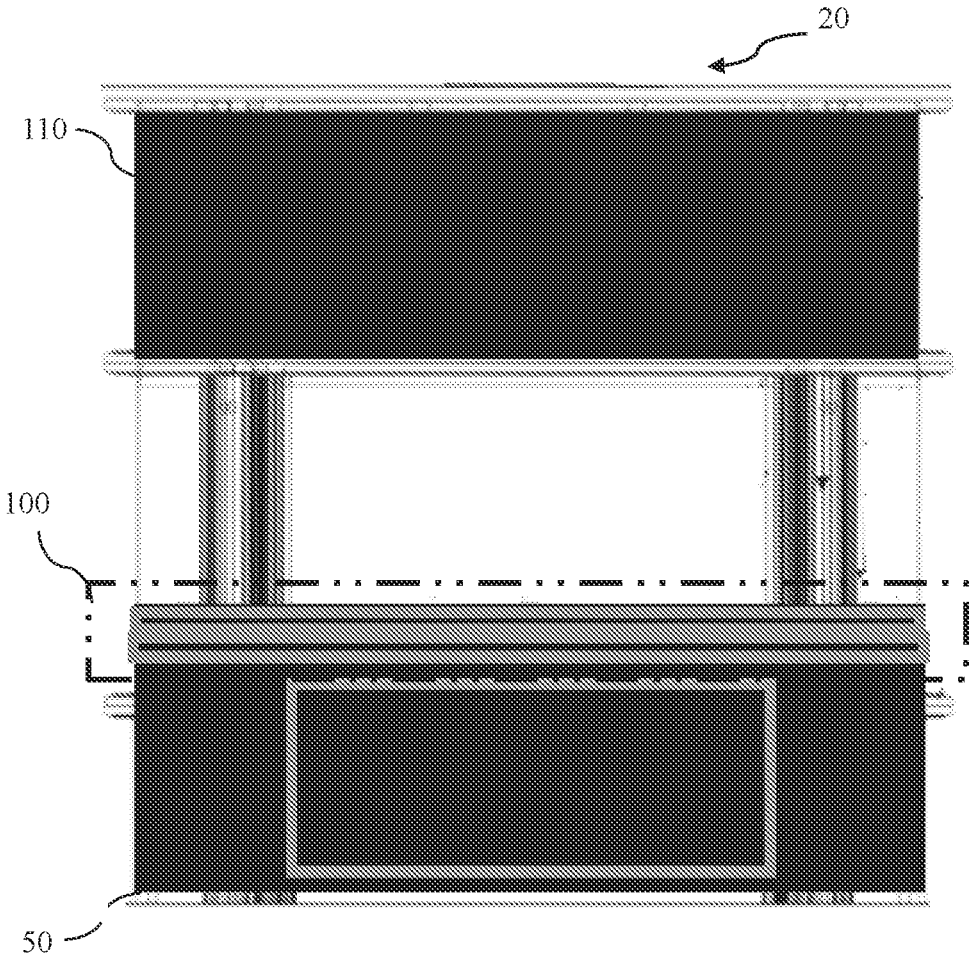
FIG. 2 is a schematic representation of a seal assembly corresponding to the pneumatic vacuum elevator in accordance with an embodiment of the present disclosure.

FIG. 2 is a schematic representation of the seal assembly 20 corresponding to the pneumatic vacuum elevator 10 in accordance with an embodiment of the present disclosure. In one embodiment, air-tight seal allows a frictionless movement of a cylindrical elevator cabin 50 (as shown in FIG. 1). The seal assembly 20 comprises of an elevator cabin structural sealing plate 100. The elevator cabin structural sealing plate 100 is adapted to fit over a top portion of a cylindrical elevator cabin 50 and below motor housing 110.

Figure 3:
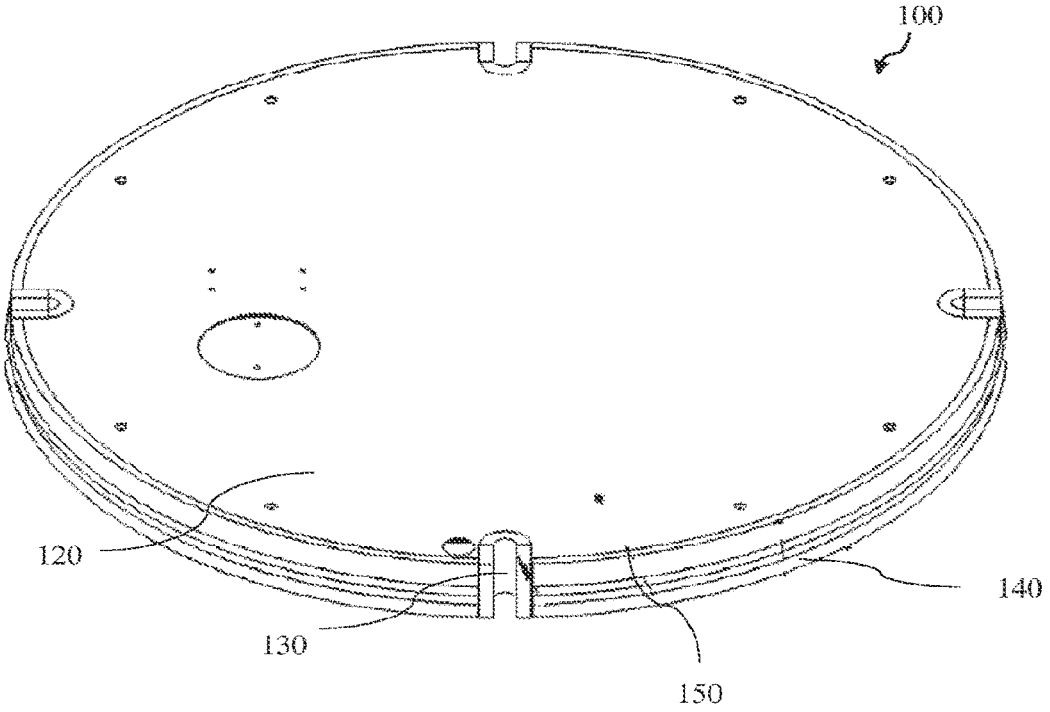
FIG. 3(*a*) is an isometric view representation of an elevator cabin structural sealing plate corresponding to the seal assembly in accordance with an embodiment of the present disclosure.
Figure 3:
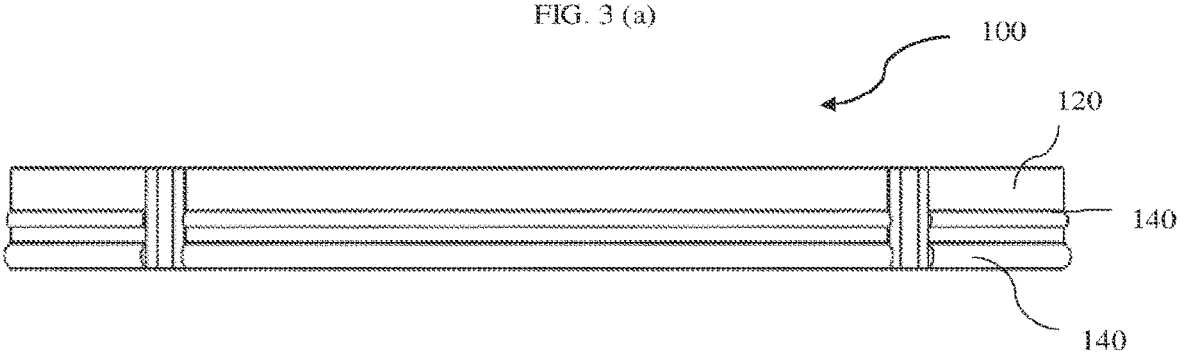
Figure 4:
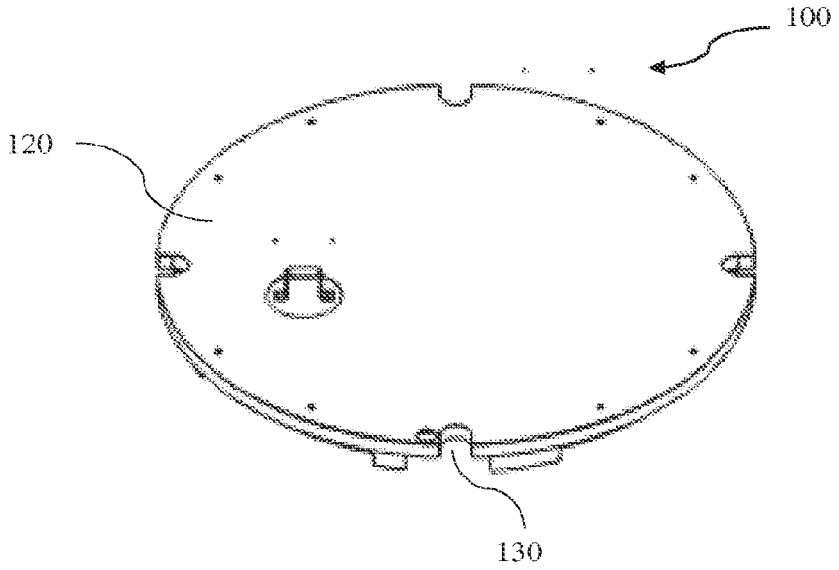
FIG. 4(*a*) is an assembled isometric top view representation of the elevator cabin structural sealing plate corresponding to the seal assembly in accordance with an embodiment of the present disclosure.
Figure 4:
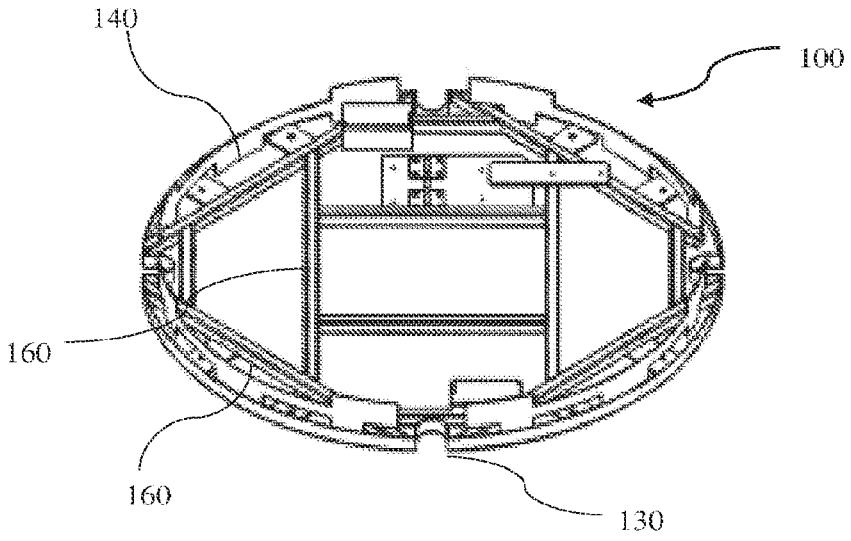

FIG. 3(*a*) is an isometric view and 3(*b*) is front view of the elevator cabin structural sealing plate 100 corresponding to the seal assembly 20 in accordance with an embodiment of the present disclosure. The elevator cabin structural sealing plate 100 is fabricated with top plate 120, seal cover outer plate 170, a plurality of u-shaped corner plates 130, at least one bumper 140 and liner plates 150 disposed over outer circumference of the seal cover outer plate 170, FIG. 4(*a*) is an assembled isometric top view representation of the elevator cabin structural sealing plate 100 corresponding to the seal assembly 20 in accordance with an embodiment of the present disclosure. FIG. 4(*b*) is an isometric bottom view representation of the elevator cabin structural sealing plate 100 corresponding to the seal assembly 20 in accordance with an embodiment of the present disclosure.

The elevator cabin structural sealing plate 100 is characterised by the top plate 120. The top plate 120 is configured to house adjoining elevator cabin structural sealing plate components with mechanical and adhesive coupling. In one embodiment, the top plate 120 is fabricated in circular shape to fit over the top surface of the cylindrical elevator cabin 50 (as shown in FIG. 1). In one specific embodiment, the top plate 120 may be fabricated with steel or any suitable material. Diameter dimensions of the circular top plate 120 is such that the top plate 120 tightly fits over the cylindrical cabin 50, thereby sealing all around the edges.

Figure 5:
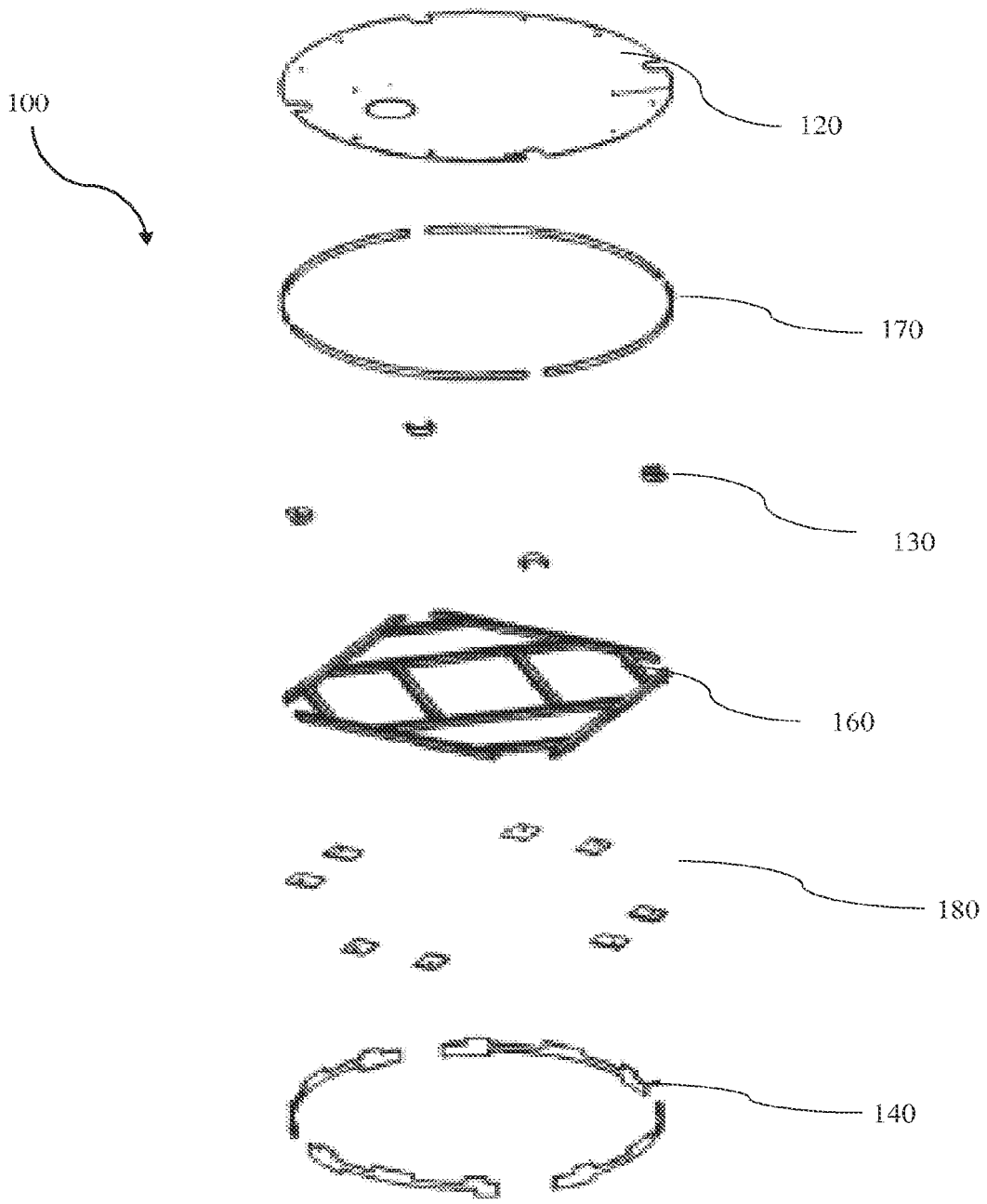
FIG. 5 is an exploded view representation of the elevator cabin structural sealing plate corresponding to the seal assembly in accordance with an embodiment of the present disclosure.

FIG. 5 is an exploded view representation of the elevator cabin structural sealing plate 100 corresponding to the seal assembly 20 in accordance with an embodiment of the present disclosure. The elevator cabin structural sealing plate 100 is characterised by a seal cover outer plate 170. The seal cover outer plate 170 is mechanically coupled along edges of the top plate 120. The seal cover outer plate 170 is configured to provide a covering to the elevator cabin structural sealing plate 100 from sideways. In one embodiment, the seal cover outer plate 170 is fabricated with steel material.

Moreover, the elevator cabin structural sealing plate 100 is characterised by a plurality of u-shaped corner plates 130. The plurality of U-shaped corner plates 130 is fabricated at outer circumference of the seal cover outer plate 170 at predefined positions. The plurality of u-shaped corner plates 130 is adapted to receive at least one guide rail. In one specific embodiment, the plurality of u-shaped corner plates 130 is fabricated at four places around the seal cover outer plate 170. In such embodiment, the four fabricated places may be at equal distance from each other over the edge of the seal cover outer plate 170.

In one embodiment, the plurality of u-shaped corner plates 130 accommodates guiding rails which facilitates upward and downward movement of the cylindrical elevator cabin 50 via the guiding rails in predefined path.

The elevator cabin structural sealing plate 100 is characterised by a set of reinforcement bars 160. The set of reinforcement bars 160 is mechanically coupled to bottom surface of the top plate 120 in lateral plane and inner circumference of the seal cover outer plate 170. The set of reinforcement bars 160 together form a predefined shape comprising a plurality of U-shaped inward depressions corresponding to the plurality of U-shaped corner plates 130 thereby supporting the plurality of U-shaped corner plates 130, the seal cover outer plate 170 and the top plate 120.

In one specific embodiment, the set of reinforcement bars 160 is fabricated with steel material. In another specific embodiment, the set of reinforcement bars 160 is arranged in square shape, touching each of the four plurality of U-shaped corner plates 130.

Furthermore, a set of seal outer ring plates is mechanically affixed with the set of reinforcement bars 160 and at least one bumper 140 and liner 150 plates. The set of seal outer ring plates enables coupling of the bumper 140 and liner 150 plates fittingly in position with the set of reinforcement bars 160. In one specific embodiment, the seal outer ring plates may be eight in number and are fabricated with steel material.

The elevator cabin structural sealing plate 100 is characterised by at least one bumper 140 and liner 150 plates. The least one bumper 140 and liner 150 plates is affixed over outer circumference of the seal cover outer plate 170 and press against inner wall of elevator cylinder 60 (as shown in FIG. 1)). The bumper 140 and liner 150 plates comprise outward protrusion which remain constantly in touch with inner wall of elevator cylinder 60 (as shown in FIG. 1 and FIGS. 6(*a*) and (*b*)).

Figure 6:
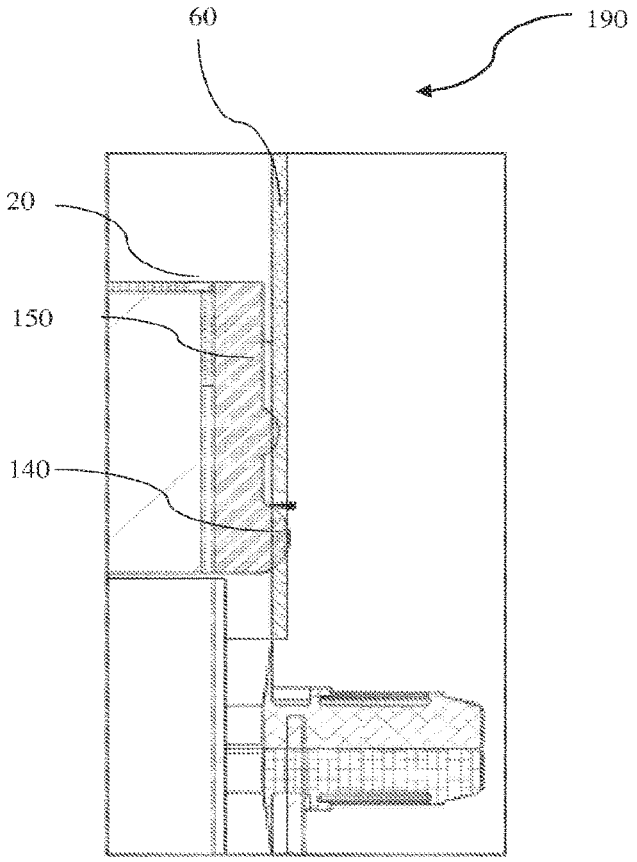
FIG. 6(*a*) illustrate the u-shaped bumper and linear plates corresponding to the seal assembly in accordance with an embodiment of the present disclosure.
Figure 6:
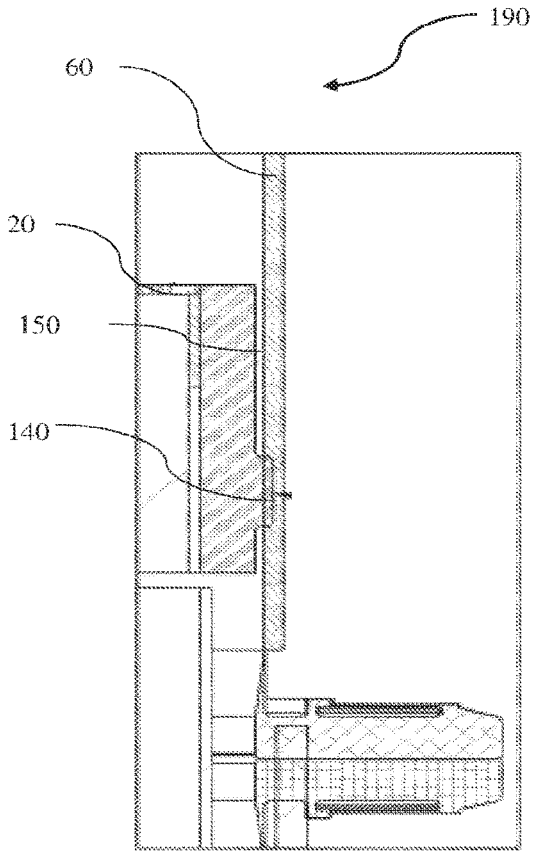

FIG. 6(*a*) illustrates the U-shaped bumper 140 and linear 150 plates 190 corresponding to the seal assembly 20 in accordance with an embodiment of the present disclosure. FIG. 6(*b*) illustrates the rectangle-shaped bumper 140 and linear 150 plates 190 corresponding to the seal assembly 20 in accordance with an embodiment of the present disclosure. In such embodiment, the constant touching of the bumper 140 and linear 150 plates with inner wall of elevator cylinder 60 (as shown in FIG. 1) enables the tight sealing the cylindrical elevator cabin 50. In addition to that, the bumper 140 and liner 150 plates reduces vibrations during upward and downward movement while maintaining sealing of the cylindrical elevator cabin 50. In one specific embodiment, at least one bumper 140 and liner 150 plates are fabricated with soft rubberized material for complete sealing.

Additionally, the elevator cabin structural sealing plate 100 is characterised by a plurality of seal stiffener plates 180. The plurality of seal stiffener plates 180 is mechanically coupled at a pre-determined gap over the top plate 120. The plurality of seal stiffener plates 180 enables holding of the seal assembly 20 over top surface of the cylindrical elevator cabin 50 during upward and downward movement.

In operation, as the elevator cabin 50 powered upward and downward through the elevator cylinder 60, the seal assembly 20 enables easy controlling of the movement. The bumpers 140 with particular shape and the linear 150 plates enable smooth ride without vibration as they are rubberised, and tightly packed with the elevator cylinder 60. During the motion of the elevator cabin 50 the reinforcement bars adds structural integrity to the seal assembly as they are tightly sealed with the elevator cylinder 60.

Present disclosure of seal assembly corresponding to a pneumatic vacuum elevator effectively solves the issue of vibration and sealing.

While specific language has been used to describe the disclosure, any limitations arising on account of the same are not intended. As would be apparent to a person skilled in the art, various working modifications may be made to the method in order to implement the inventive concept as taught herein.

The figures and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, order of processes described herein may be changed and are not limited to the manner described herein. Moreover, the actions of any flow diagram need not be implemented in the order shown; nor do all of the acts need to be necessarily performed. Also, those acts that are not dependent on other acts may be performed in parallel with the other acts. The scope of embodiments is by no means limited by these specific examples.

I claim:

1. A seal assembly for a pneumatic vacuum elevator, comprising:

an elevator cabin structural sealing plate adapted to fit over a top portion of a cylindrical elevator cabin, characterised by:

a top plate configured to house adjoining elevator cabin structural sealing plate components with mechanical and adhesive coupling, wherein the top plate is fabricated in circular shape to fit over the top surface of the cylindrical elevator cabin;

a seal cover outer plate mechanically coupled along edges of the top plate, wherein the seal cover outer plate is configured to provide a covering to the elevator cabin structural sealing plate from sideways, a plurality of U-shaped corner plates fabricated at outer circumference of the seal cover outer plate at predefined positions, wherein the plurality of U-shaped corner plates is adapted to receive at least one guide rail thereby enabling upward and downward movement of the cylindrical elevator cabin via the guiding rails in predefined path;

a set of reinforcement bars mechanically coupled to bottom surface of the top plate in lateral plane and inner circumference of the seal cover outer plate, wherein the set of reinforcement bars together form a predefined shape comprising a plurality of u shaped inward depressions corresponding to the plurality of U-shaped corner plates thereby supporting the plurality of U-shaped corner plates, the seal cover outer plate and the top plate;

at least one bumper and liner plates affixed over outer circumference of the seal cover outer plates and press against inner wall of elevator cylinder, wherein the bumper and liner plates comprise outward protrusion which remain constantly in touch with inner wall of elevator cylinder thereby sealing the cylindrical elevator cabin and reducing vibrations during upward and downward movement.

2. The seal assembly as claimed in claim 1, further comprising a plurality of seal stiffener plates mechanically coupled at a pre-determined gap over the top plate, wherein the plurality of seal stiffener plates enable holding of the seal assembly over top surface of the cylindrical elevator cabin during upward and downward movement.

3. The seal assembly as claimed in claim 1, further comprising a set of seal outer ring plates mechanically affixed with the set of reinforcement bars and the at least one bumper and liner plates, wherein the set of seal outer ring plates enables coupling of the bumper and liner plates fittingly in position.

4. The pneumatic vacuum elevator as claimed in claim 1, wherein the at least one bumper and the liner plates are fabricated with soft rubberized material for complete sealing.

5. The pneumatic vacuum elevator as claimed in claim 1, wherein the at least one bumper is fabricated in U-shaped or rectangle shaped when tightly packed along the seal cover outer plate.

* * * * *